US005727420A

United States Patent [19]

Tseng

[11] Patent Number: 5,727,420

[45] Date of Patent: Mar. 17, 1998

[54] RECOVERABLE AND REUSABLE COLD FORGING DIES

[76] Inventor: Shao-Chien Tseng, No. 130, Sec 2, Yang-Shin Rd., Yang-Mei Taoyuan 326, Taiwan

[21] Appl. No.: 792,687

[22] Filed: Jan. 29, 1997

[51] Int. Cl.[6] ..... B21J 13/02

[52] U.S. Cl. ..... 72/462; 76/107.1

[58] Field of Search ..... 72/462, 476; 76/107.1

[56] References Cited

U.S. PATENT DOCUMENTS 3,125,974 3/1964 Toulmin, Jr. ..... 76/107.1
4,509,358 4/1985 Krowl ..... 76/107.1

*Primary Examiner*—Lowell A. Larson
*Attorney, Agent, or Firm*—Pro-Techtor International

[57] ABSTRACT

A recoverable and reusable cold forging die, including: a metallic die frame, a bottom lid having several metallic strut spacers and bolt holes, a plastic film made of PET or PVC plastic material provided on the top of the die frame, several sheets of Kevlar fibers as an upper filler layer, and several sheets of stainless steel as a lower filler layer, the bottom lid is added after turning upside down of the die, mercury and steel beads or iron sand are poured into the bolt holes until full loading, then they are fast frozen under a low temperature below −40° C., thus the cold forging die resistive to cold forging punching pressure is formed, after forging, the die is defrozen to recover the mercury and to detach the plastic film, the recoverable and changeable cold forging die can be reused by changing the cavity thereof.

5 Claims, 2 Drawing Sheets

RECOVERABLE AND REUSABLE COLD FORGING DIES

BACKGROUND OF THE INVENTION

1. Field of the Invention

The present invention relates to a die used for processing of metall cold forging, and especially to a recoverable and reusable cold forging die.

2. Description of the Prior Art

The existing forging techniques are divided into cold and hot forging modes: cold forging is that a given die is used under a normal temperature to press and forge metallic castings as finished products having the required shape; while hot forging is that metallic castings are preheated in a given temperature and then are pressed and forged to form finished products having the required shape; while can be seen that, crystal texture of metallic castings themselves before cold forging is not damaged, while crystal texture of metallic castings themselves before hot forging is softened or even oxygenized during heating process; so that as to forge strength, when in cold forging, metallic texture of the castings is not subjected to heat to be softened, hence the required forging pressure for a die used in forging castings is higher than that in hot forging, and naturally, metal strength of the working pieces after cold forging is also higher, this is the main reason why larger forging pressure is required in a cold forging process.

In the case that higher forge strength is required in cold forging process, pressure bearing strength of a die is extremely important, taking the process available nowadays as an example, an operator normally uses alloy steel (SKD11) of nickel, chromium and molybdenum as the metallic material for a die wherein a forging cavity is formed to bear transient cold forging punching pressure; and as to the procedure of forming the cavity, the existing techniques mostly use nowadays automation synthetic processing equipments (such as a CNC machine center) to do metallic processing on the above mentioned alloy steel die to form the cavity and complete the die; however, a die formed of metallic material such as alloy steel of nickel, chromium and molybdenum appears in stiff state in that a predetermined cavity shape is given and not changeable, so that every die can only be used for forging work pieces in coincedence with the shape of the cavity of the die, and can not be used for others; besides, such steel dies cost very high, this is the largest trouble encountered in using the existing steel cold forging dies.

SUMMARY OF THE INVENTION

In view of the inferior effect as stated above resulted by the steel cold forging die devices, and trouble of overly high cost for the process of forming forging cavities, after study and development, the present invention is provided in having the following objects and characteristics:

The objects of the present invention are: providing a recoverable and reusable cold forging die which allows the shape of the cavity of the die changeable under a normal non-freezing temperature, and strength of the fillers therein increasable and decreasable so that it can bear forging pressure after quick freezing.

To achieve the above stated objects, the recoverable and reusable cold forging die provided in the present invention can be used to form a plastic film in conformity to the shape of the cavity of the die, and especially to form the plastic film of PET or PVC plastic material which is easy to be formed by the vacuum forming technique, then the plastic film is applied on the die as a basic layer of the die cavity; and take advantage of the softness and flexibility of Kevlar fibers and their high resistance to punch pressure to use them as an upper filler layer on the bottom of the plastic film; further take advantage of the nature of corrosion resistance, capability of bending and the effect of spreading bearing force against pressure load of a stainless steel net to use it as a lower filler layer beneath the upper filler layer; these fillers are supported by a suitable amount of strut spacers provided beneath the die, then mercury is poured into the above stated structure in the die, by the nature that liquid mercury has high specific weight and penetrability under a normal temperature, and its penetrability through the stainless steel net meshes, and further through the fine woven gaps on the Kevlar fibers, the loose gaps on the uncompacted layers of the fillers can all be fully filled with the liquid mercury; then take advantage of the nature of expansion of mercury when it is solidified under a low temperature, the net meshes and the fine woven gaps on the fillers in the die can all be fully filled with mercury; and a suitable amount of iron sand or steel beads are added into the mercury to reinforce compressive strength of the mercury after solidification, thus the cold forging die resistive to transient cold forging punching pressure is formed.

The present invention has the following technical points:

1. Its die cavity is made of PET or PVC plastic material, and a plastic film in conformity to the shape of the cavity of the die can be easily preformed by the known vacuum forming technique; therefore, a maker can easily preform various plastic films in conformity to the shapes of the cavities of dies desired.

2. Several layer of cloth like Kevlar fibers are used as the upper filler layer of bottom of the plastic film; such Kevlar fibers are soft and flexible, and also are provided with very high tenacity and compressive strength, they are filled normally in a shellproof vests to prevent from penetration of bullets; flexibility the can render them conforming with the shape of the cavity of the die and closely clinging to the bottom surface of the plastic film to thereby enhance the strength resistive to the forging pressure of the surface of the plastic 3. Several layer of stainless nets are lapped on the bottom of the upper filler layer to form the lower filler layer of the plastic film; the stainless steel net has the nature of corrosion resistance, the capability of bending and the effect of spreading bearing force against pressure load, when it is bended in pursuance of the contour of the bottom of the upper filler layer in lapping, forging pressure exerted thereon can be diffused by its net meshes, this further enhances compressive strength thereof.

4. The upper and the lower filler layers are supported by a plurality of strut spacers provided beneath the die and arranged in pursuance of the shape of the die; these strut spacers are made of manganese steel or alloy steel having the required compressive strength, so that the strut spacers can enhance compressive strength of the plastic film and the upper and the lower filler layers on the bottom thereof in the die against forging pressure.

5. Mercury is poured into the die as a medium of penetration in the gaps between the filler layers on the bottom of the plastic film and the strut spacers, by the nature that liquid mercury has high specific weight and penetrability under a normal temperature, and its penetrability through the fine woven gaps on the cloth like Kevlar fibers and through the stainless steel net meshes, the gaps between the filler layers on the bottom of the plastic film and the strut spacers can thereby full filled with the liquid mercury.

6. Take advantage of the nature of expansion of mercury when it is fast frozen and solidified, the gaps on the fillers in the die can all be compacted and fully filled with mercury; the expansion pressure is released through a plurality of bolt holes provided on a bottom lid, so the die is completed with a revealed cavity and with the above stated fillers enveloped therein having the nature resistive to pressure.

7. The mercury in the die is in liquid form under a normal temperature and is flowable for pouring, therefore, when it is fast frozen and solidified to be used as a medium of penetration in the die, it can be defrozen to recover its liquid form under a normal temperature, hence it can be recollected or recovered temporarily to allow releasing of the used layers of fillers, and then the plastic film and the fillers can be replaced with a plastic film and other fillers in layers in conformity to other shaped die cavity, so that an object of repeated recovery for reusing can be achieved.

8. A suitable amount of iron sand or steel beads are added into the die before pouring of the mercury therein, hence after pouring, the mercury envelops the iron sand or steel beads to reinforce compressive strength of the mercury after solidification.

9. The present invention allows detaching and changing of the body of the die cavity and reinforcing of the die for cold forging, due to the plastic film, the fillers and the medium of penetration in the die cavity all have the characteristic of recoverability and variability in amount as well as changeability, cost of reproduction of dies can thus be reduced and practical effect of utility can be increased.

Knowing the above stated objects and the technical points, the present invention will be apparent in its method and practical function after reading the detailed description of the preferred embodiment thereof in reference to the accompanying drawings.

DETAILED DESCRIPTION OF THE PREFERRED EMBODIMENT

Figure 1:
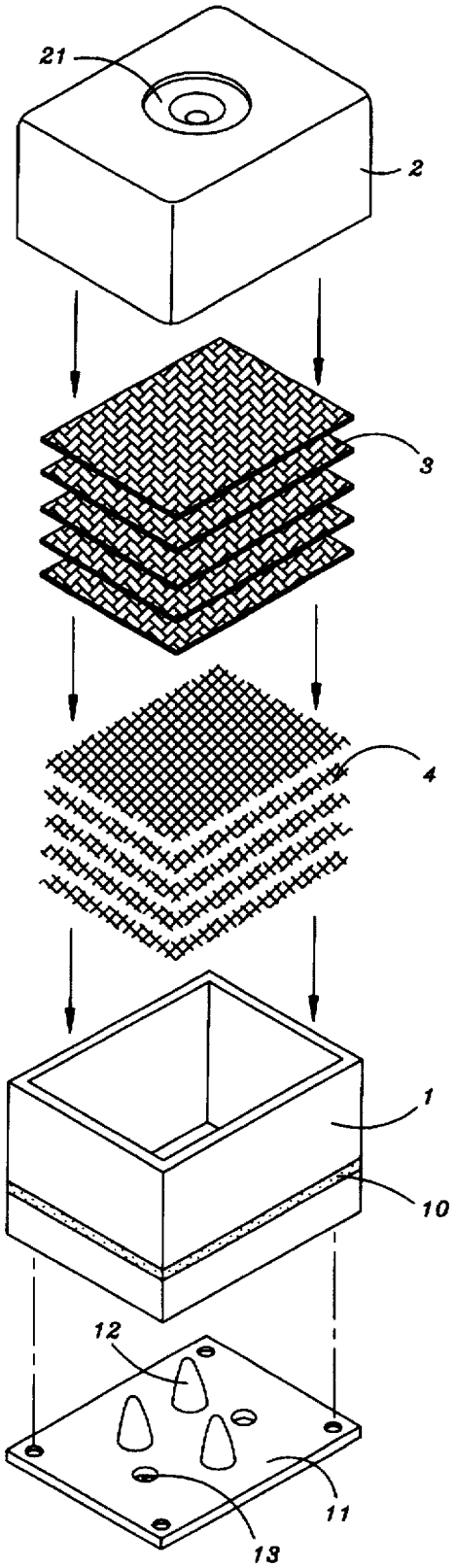
FIG. 1 is an analytical perspective view of the basic die structure of the present invention in assembling.

As shown in FIG. 1, the basic structure of the cold forging die of the present invention is comprised of a die frame 1 made of metallic material which is opened on the top and the bottom ends thereof, a bottom lid 11 is provided on the bottom end thereof, a plurality of strut spacers 12 are provided by welding on the bottom lid 11 and can be made of manganese steel or other alloy steel, the bottom lid 11 and the die frame 1 can also be made of material having the required strength, the bottom lid 11 is provided with more than one bolt holes 13 to communicate with the outside, to be used as mercury pouring holes or discharging holes, for releasing pressure and air inspiration, and as specific holes for offsetting expansion.

Before providing of the bottom lid 11 on the die frame 1, a plastic film 2 is provided on the top thereof, the plastic film 2 is made of PET or PVC plastic material in pursuance of the shape of the workpiece to be forged by the known vacuum injection forming technique, and hence has a cavity 21 of the die in the shape required, the plastic film 2 is provided at the edges thereof with extended covering surfaces which are to be applied with a layer of glue 10 (FIG. 2 or FIG. 3) when the plastic film 2 is assembled on the die frame 1, so that the surrounding covering surfaces of the plastic film 2 are firmly sticked to the walls of the die frame 1; then several sheets of upper fillers 3 with larger area than that of the frame opening are placed in the die frame 1, these sheets are lapped over and closely stuck to the bottom contouring surface of the plastic film 2; the upper filler layer 3 formed by lapping over of the sheets are made of cloth like Kevlar fibers which have high compressive strength and softness and flexibility, so that they can be conformed with the bottom of the plastic film 2 and are fully compacted thereto by pressing thereon, spreading with a coincedent contour to that of the cavity 21.

Several sheet of stainless steel meshes forming a lower filler layer 4 are lapped over on the bottom of the upper filler layer 3, so that the upper and the lower filler layers 3, 4 are lapped with each other on the bottom of the plastic film 2; the lower filler layer 4 formed by several sheet of stainless steel nets has the effect of bending, bearing load and spreading bearing force against the forging pressure load transmitted from the upper Kevlar fibers, and can enhance the compressive strength of the plastic film 2.

Figure 2:
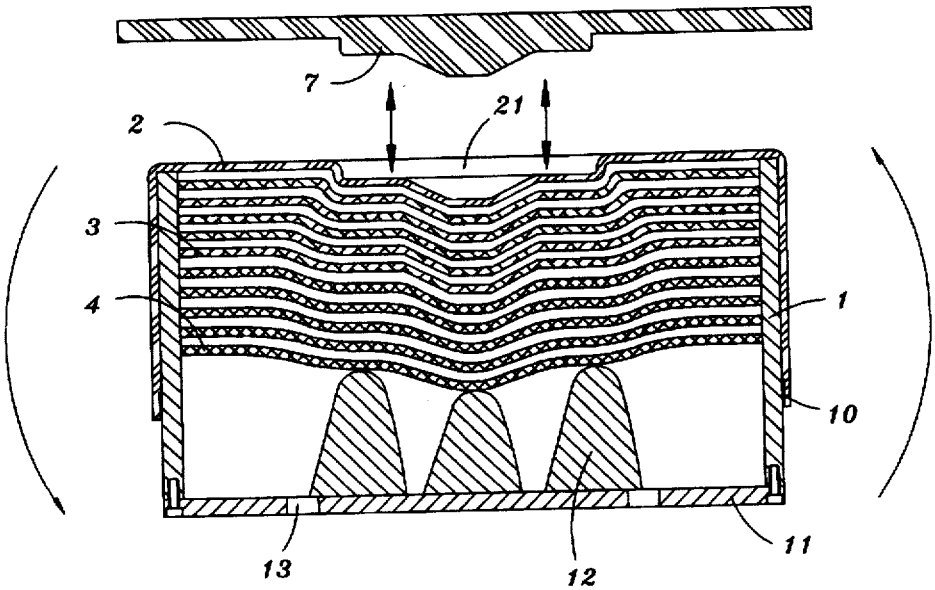
FIG. 2 is an assembled sectional view of the basic die structure of the present invention.

Then the bottom lid 11 covers the bottom of the die frame 1, so that the tops of the strut spacers 12 can support the meshed lower filler layer 4 in case it collapses, thus the basic structure of the cold forging die of the present invention is completed (as shown in FIG. 2).

Figure 3:
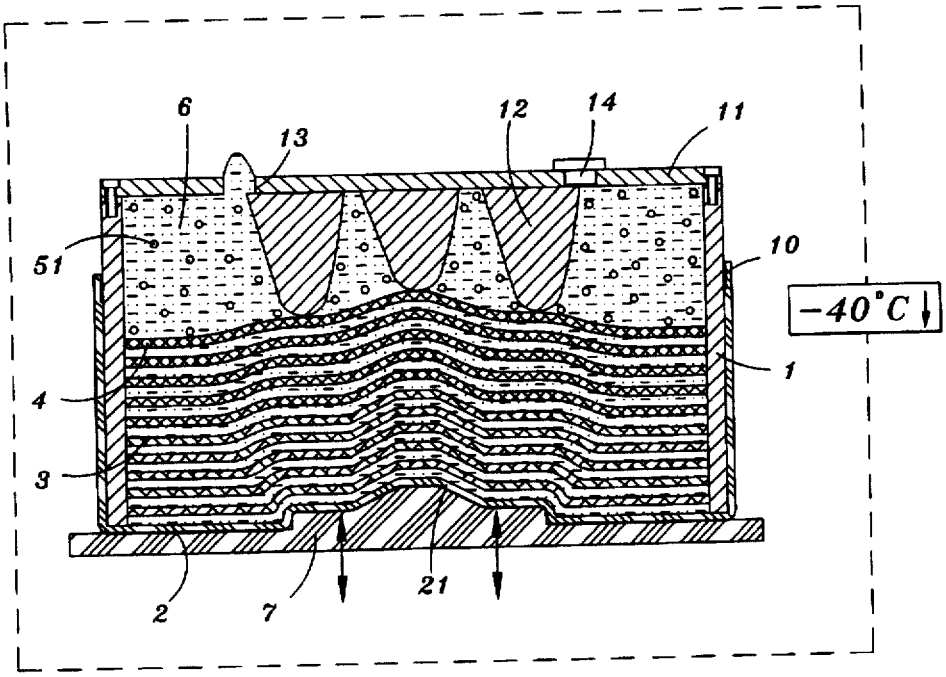
FIG. 3 is a sectional view showing pouring of the medium of penetration of the basic die structure of the present invention.

Turn upside down the above stated basic structure as is shown in FIG. 3, the plastic film 2 is lapped with its cavity 21 on a male die 7 conforming in shape with the cavity 21, the male die 7 can be formed of hard industrial plastic which is easier formed (as is well known), so that it can hold up the plastic film 2 before pouring of liquid mercury to prevent from collapse of the plastic film 2 due to loading in of the liquid mercury of high specific weight; steel beads 51 (or iron sand) of suitable granularity are poured into any bolt hole 13 on the bottom lid 11 under a normal temperature, and also mercury 6 is poured into any bolt hole 13, by its very high penetrability, the mercury 6 penetrates the meshes of the stainless steel net in the lower filler layer 4, and also the fine woven gaps on the Kevlar fibers of the upper filler layer 3, so that the space in the interior of the die is nearly fully filled, suitable bolt holes 13 can be provided with plugs 14 for closing it, at least one bolt hole 13 is left to communicate with the atmosphere, the whole inversed die is then fast frozen, because that consolidation temperature of the mercury 6 is −38.5° C., therefore, the die of the present invention has to be fast frozen under a temperature below −40° C., while freezing time is depending on the fast freezing equipment used, what is significant is that the mercury 6 in the die must be adequately consolidated after fast freezing, and will gradually expand during consolidation to fully fill in the gaps between the filler layers, surplus solid mercury 6 extruded during expansion is expelled from the opened bolt holes 13 and can be scraped away according to the situation of the die shelf, so that a frozen die capable of being used in cold forging to bear forging pressure; the frozen die must be used for cold forging before the frozen mercury 6 is defrozen, therefore, a fast freezing equipment is extremely necessary at the position beside the cold forging unit. Naturally, the known automatic control equipments for turning over the die and transferring the die shelf used between the freezing equipment and the cold forging unit are also extremely necessary, they are the known techniques though, and are not the point of the present invention, so they are not narrated in detail herein.

After the frozen die is used for such transient cold forging, if it is to be used intermittently, it can be placed in a fast freezing equipment to keep the low temperature to prevent the frozen mercury 6 from defreezing, and is taken out of the die shelf rapidly to be used for cold forging process; in other words, if the cavity 21 is requested to be replaced, it needs only to place the die under a normal temperature to allow the frozen mercury 6 therein to be self defrozen, the plug 14 can then be removed to release automatically the frozen mercury 6 in the die to be recovered for use in loading thereof in the next time, at this time, the plastic film 2 on the top of the die frame 1 can be taken off, therefore, the plastic film 2 can be replaced with a plastic film in conformity to a required cavity 21, and other fillers in layers 3, 4 in conformity to the new plastic film can be lapped over and compacted on the new plastic film to be conformed with the shape of the new plastic film; and by increasing or decreasing the number and thickness of the filler layers 3, 4 as well as amount of the steel beads (or iorn sand) added, they can get the required compressive strength for bearing forging pressure; and then the procedures of pouring and solidifying of the mercury 6 are repeated, so that the recoverable and changeable cold forging die in conformity to the required die cavity is completed.

The above stated cold forging die can be applied dividing into an upper and a lower die portions; the slots prepared in pursuance of requirement on the periphery of the die frame 1 can be added according to the requirement by an automatic or a man controlled die shelf equipment.

The above stated cold forging die can also be applied wholly in a cold forging set which is contained in a fast freezing-temperature controlling chamber, and is used for keeping the mercury 6 in a low temperature freezing state in practising the cold forging process. In the operation procedure of the above stated cold forging die, the die must be subjected to forging punching pressure under a low temperature of below −40° C., in this view, the die frame 1 and the bottom lid 11 can be made of medium carbon steel (such as F45C), and are welded to the strut spacers 12 provided on the bottom lid 11, the strut spacers 12 is also made of medium carbon steel or manganese steel having higher compressive strength, the die frame 1, the strut spacers 12 and the bottom 11 keep very good compressive strength under a low temperature when the mercury 6 is frozen, thus can bear forging punching pressure; moreover, the upper and the lower filler layers 3, 4 and the plastic film 2 are relatively soft under a normal temperature, while after pouring of the mercury 6 therebetween, and if the mercury 6 is solidified, the filler layers 3, 4 and the plastic film 2 are reinforced to be more resistive to forging punching pressure.

Having thus described my invention, what I claim as new and desire to be secured by Letters Patent of the United States is:

1. A recoverable and reusable cold forging die, including:

a plastic film made of PET or PVC plastic material having a die cavity in pursuance of the shape of the work-piece to be forged;

several sheets of Kevlar fibers as an upper filler layer, and several sheets of stainless steel as a lower filler layer;

said plastic film being provided on the top of a die frame, said upper filler layer being lapped over in said die frame, so that it conforming with the bottom of said plastic film and being fully compacted thereto by pressing thereon, spreading with a coincedent contour to that of said die cavity;

said lower filler layer being lapped on the bottom of said upper filler layer in said die frame, so that said upper and lower filler layers being lapped over in sequence spreading and being compacted on the bottom of said plastic film on said die frame;

a bottom lid being provided on said die frame, a plurality of strut spacers being provided by welding on said bottom lid, said bottom lid being provided with more than one bolt holes, said strut spacers supporting the bottom of said lower filler layer, thus forming a basic structure of said cold forging die;

turning upside down said die, said plastic film being supported with its cavity on a male die conforming in shape with said cavity, steel beads or iron sand of suitable amount being poured into said bolt holes, and also mercury being poured into said bolt holes to render the space in the interior of said die fully filled, the surplus bolt holes being sealed with plugs, at least one bolt hole being left to allow said mercury to release pressure when in consolidation, said die with mercury therein being fast frozen then under a low temperature below −40° C., so that said mercury in said die together with said steel beads or iron sand being consolidated and expanded and hardened to fully fill the gaps therein, thus completing said cold forging die resistive to cold forging punching pressure.

2. A recoverable and reusable cold forging die as defined in claim 1, being characterized in that:

amount of sheets of material lapped in said upper and lower filler layers respectively can be increased or decreased according to the desired compressive strength of said die formed.

3. A recoverable and reusable cold forging die as defined in claim 1, being characterized in that:

amount of said steel beads or iron sand can be increased or decreased according to the desired compressive strength of said die, said steel beads or iron sand can be mixed with said mercury, in order to reinforce resistance of said cold forging die to cold forging punching pressure.

4. A recoverable and reusable cold forging die as defined in claim 1, being characterized in that:

frozen mercury in said die can be defrozen to be released from said bolt holes, thereby to release said upper and lower filler layers and said plastic film in said die, when it is defrozen to a normal temperature, said plastic film can be replaced with a new one having a required die cavity.

5. A recoverable and reusable cold forging die as defined in claim 4, being characterized in that:

defrozen and released filler layers under a normal temperature can be changed with new ones together with said new plastic film having a required die cavity, and are spreaded and compacted on the bottom of said plastic film with a coincedent contour to that of said required die cavity, amount of sheets of material lapped in said upper and lower filler layers respectively can be increased or decreased in order that said cold forging die to be resistive to cold forging punching pressure.

* * * * *